US009574772B2

(12) United States Patent
Vendramini

(10) Patent No.: US 9,574,772 B2
(45) Date of Patent: Feb. 21, 2017

(54) CONTROL AND SAFETY CIRCUIT FOR GAS DELIVERY VALVES

(75) Inventor: Antonio Vendramini, Padua (IT)

(73) Assignee: SIT S.P.A., Padua (IT)

( * ) Notice: Subject to any disclaimer, the term of this patent is extended or adjusted under 35 U.S.C. 154(b) by 20 days.

(21) Appl. No.: 14/006,916

(22) PCT Filed: Mar. 13, 2012

(86) PCT No.: PCT/EP2012/054333

§ 371 (c)(1),
(2), (4) Date: Sep. 23, 2013

(87) PCT Pub. No.: WO2012/126768

PCT Pub. Date: Sep. 27, 2012

(65) Prior Publication Data

US 2014/0007957 A1 Jan. 9, 2014

(30) Foreign Application Priority Data

Mar. 24, 2011 (IT) ..... PD2011A0090

(51) Int. Cl.
*F23N 5/24* (2006.01)
*F23N 1/00* (2006.01)

(52) U.S. Cl.
CPC ..... *F23N 5/24* (2013.01); *F23N 1/002* (2013.01); *F23N 5/242* (2013.01); *F23N 2023/04* (2013.01); *F23N 2023/08* (2013.01); *F23N 2035/14* (2013.01); *Y10T 137/8158* (2015.04)

(58) Field of Classification Search
CPC ..... F23N 1/002; F23N 5/242; F23N 2023/04; F23N 2035/14; F23N 2023/08; Y10T 137/8158; F16K 31/02; F16K 31/0675; F16K 31/046; F16K 37/00
USPC ..... 137/264.11; 251/129.04
See application file for complete search history.

(56) References Cited

U.S. PATENT DOCUMENTS

2003/0143503 A1* 7/2003 Wild et al. ..... 431/69
2008/0096147 A1 4/2008 Newsom

FOREIGN PATENT DOCUMENTS

| | | | |
|---|---|---|---|
| EP | 0497147 | A2 | 8/1992 |
| EP | 1199518 | A2 | 4/2002 |
| GB | 2229841 | A | 10/1990 |
| JP | 1028415 | A | 1/1989 |

OTHER PUBLICATIONS

Digital Fundamentals, Thomas L. Floyd, Prentice Hall, 7th Edition, 2000, ISBN 0-13-080850.*

* cited by examiner

*Primary Examiner* — Matthew W Jellett
(74) *Attorney, Agent, or Firm* — Volpe and Koenig, P.C.

(57) ABSTRACT

This invention relates to a control and safety circuit (1) for gas delivery valves, comprising an actuator (50) opening the gas delivery valve; a control unit (100) intended to emit a command signal ($V_2$) to activate the actuator and switch on the valve, and a clock signal (CK); and a memory (5) placed between the control unit (100) and the actuator (50). The memory is capable of receiving the command signal ($V_2$) and the clock signal (CK) as inputs, and at the same time emits an output signal ($V_3$) which is a function of the input command signal ($V_2$) and a clock signal (CK). The output signal ($V_3$) is sent to the actuator (50) to command the same to open the valve.

8 Claims, 2 Drawing Sheets

CONTROL AND SAFETY CIRCUIT FOR GAS DELIVERY VALVES

TECHNICAL SCOPE OF THE INVENTION

This invention relates to a control and safety circuit for gas delivery valves, in particular for boilers for domestic use, according to claim no. 1. Through this invention the risk of delivering undesired gas is minimised, while at the same time the relative cost of the circuit is kept low.

TECHNICAL BACKGROUND

According to current regulations the safety measures to which gas delivery valve control boards, and more particularly the electrical control circuits which energise/de-energise valves through which combustible gas is delivered, are subjected are particularly stringent regulations. Among others these regulations apply to the boilers present for example in domestic heating systems.

In particular many "redundant" systems and devices to prevent the undesired delivery of gas if any component in the valve control circuit should fail or no longer function correctly must be provided within such circuits in order to comply with the reference regulations.

In general, in existing control circuits a microcontroller capable of controlling an actuator, for example a relay, to open/close a combustible gas delivery valve is often present. Because faults are also possible in the microcontroller itself, another control circuit must preferably "replace" the circuit included in the microcontroller if the latter should fail. In a possible embodiment this second control circuit may also include a supervisory element, such as a microcontroller, to control opening and closing of the valve through a separate signal delivered to the actuator (or to a separate actuator) so that the valve can open and deliver gas only in the situation where both the signals reach the actuator, which is then controlled in such a way as to permit the delivery of gas. If one of the two microcontrollers should fail, and if both should fail simultaneously, the valve will remain closed.

One of then disadvantages of this technical solution lies in the fact that because it is necessary to make these control circuits relatively economical so that they can be competitive in the market in question the presence of two microcontrollers results in an excessive increase in the final cost of the board controlling the valve.

British patent application GB 2229841 describes a fuel-heated device, for example a water heater, which has at least one fail-safe device which blocks delivery of fuel to the equipment's burner in the event of a fault, which is fed with electrical current and can only be deliberately unlocked through a control. In order to be able to maintain and use the fault information in this fail-safe device if there should be a power cut, the electronic fail-safe device is connected to a device which records the length of a power cut and which according to a preferred embodiment of the equipment comprises a non-volatile read-only semiconductor memory (EEPROM) which can be cancelled electrically.

SUMMARY OF THE INVENTION

The object of this invention is therefore that of providing a control and safety circuit for gas delivery valves in which opening of the valve depends on—at least—the delivery of two signals which are substantially independent of each other to control an actuator in order to control the delivery of gas in a manner which is quite safe.

The object of this invention is to provide such a circuit having a simplified structure, high safety and low cost, which at the same time is able to overcome the limitations mentioned with reference to the cited known art.

This and other objects which will be more apparent below are achieved by the invention through a control and safety circuit constructed according to the following claims.

BRIEF DESCRIPTION OF THE DRAWINGS

Further features and advantages of the invention will be more apparent from the following detailed description of a preferred embodiment illustrated by way of indication and without limitation with reference to the appended drawings in which.

PREFERRED EMBODIMENTS OF THE INVENTION

Figure 1:
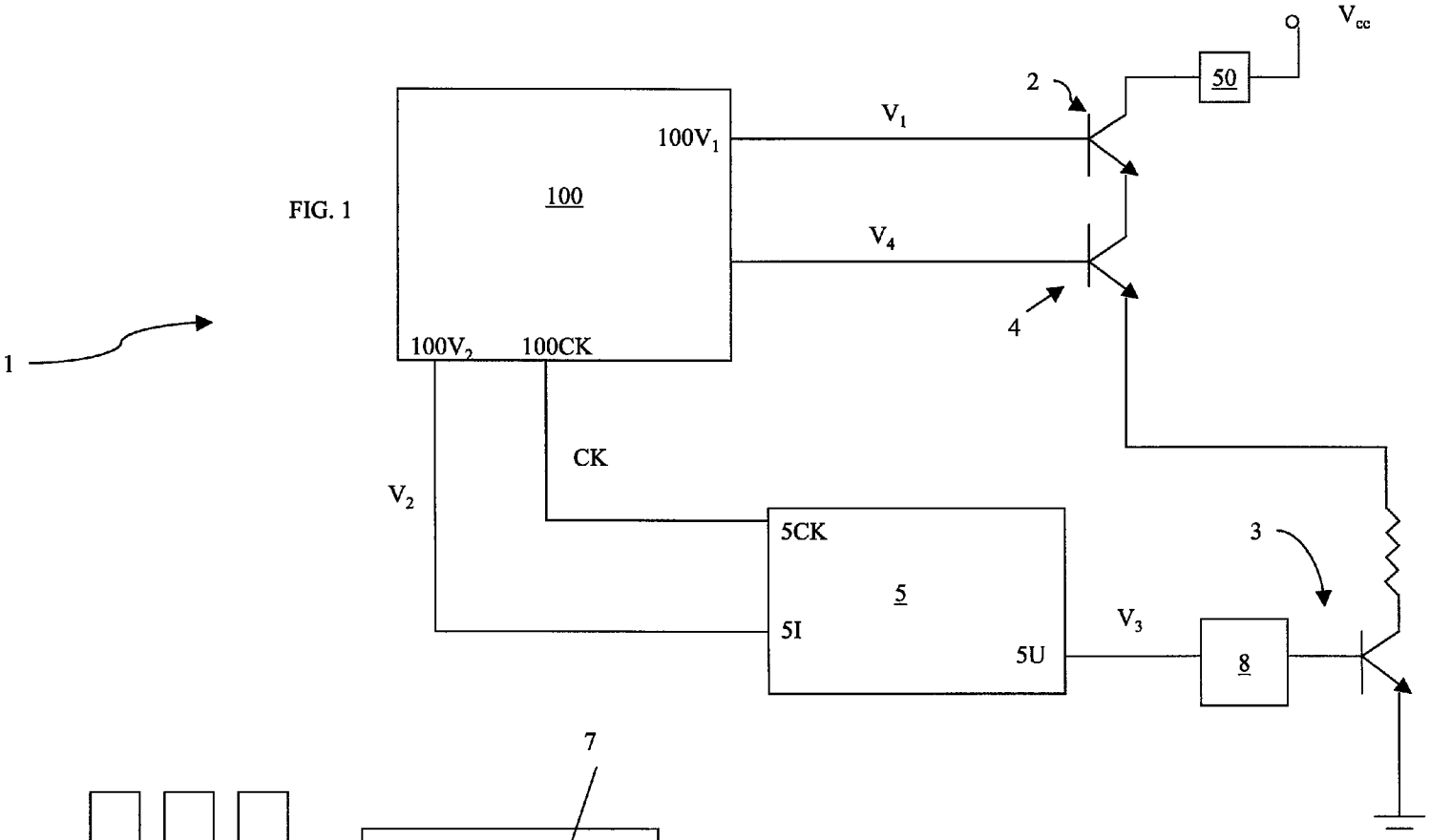
FIG. 1 is a simplified circuit diagram of a control and safety circuit constructed according to this invention.

Initially with reference to FIG. 1, 1 indicates as a whole a control circuit for a valve for the delivery of gas along a pipe (not shown) according to this invention, to control the delivery of combustible gas delivered to a burner or other similar device, also not shown in the figure.

Figure 3:
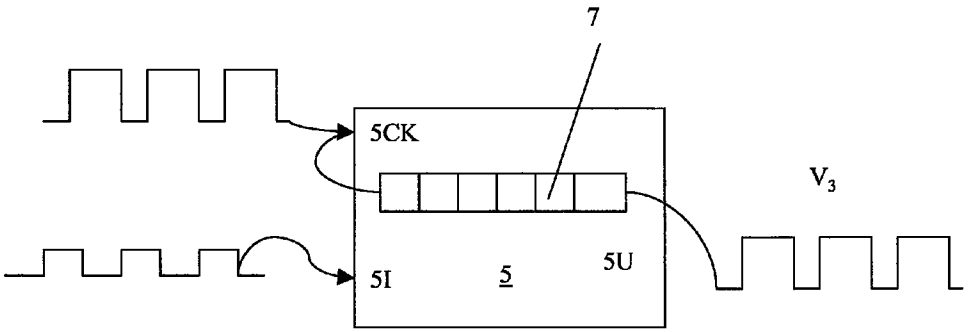
FIG. 3 is a diagrammatical representation of the input and output signals from a component of the circuit in FIG. 1 or FIG. 2.
Figure 2:
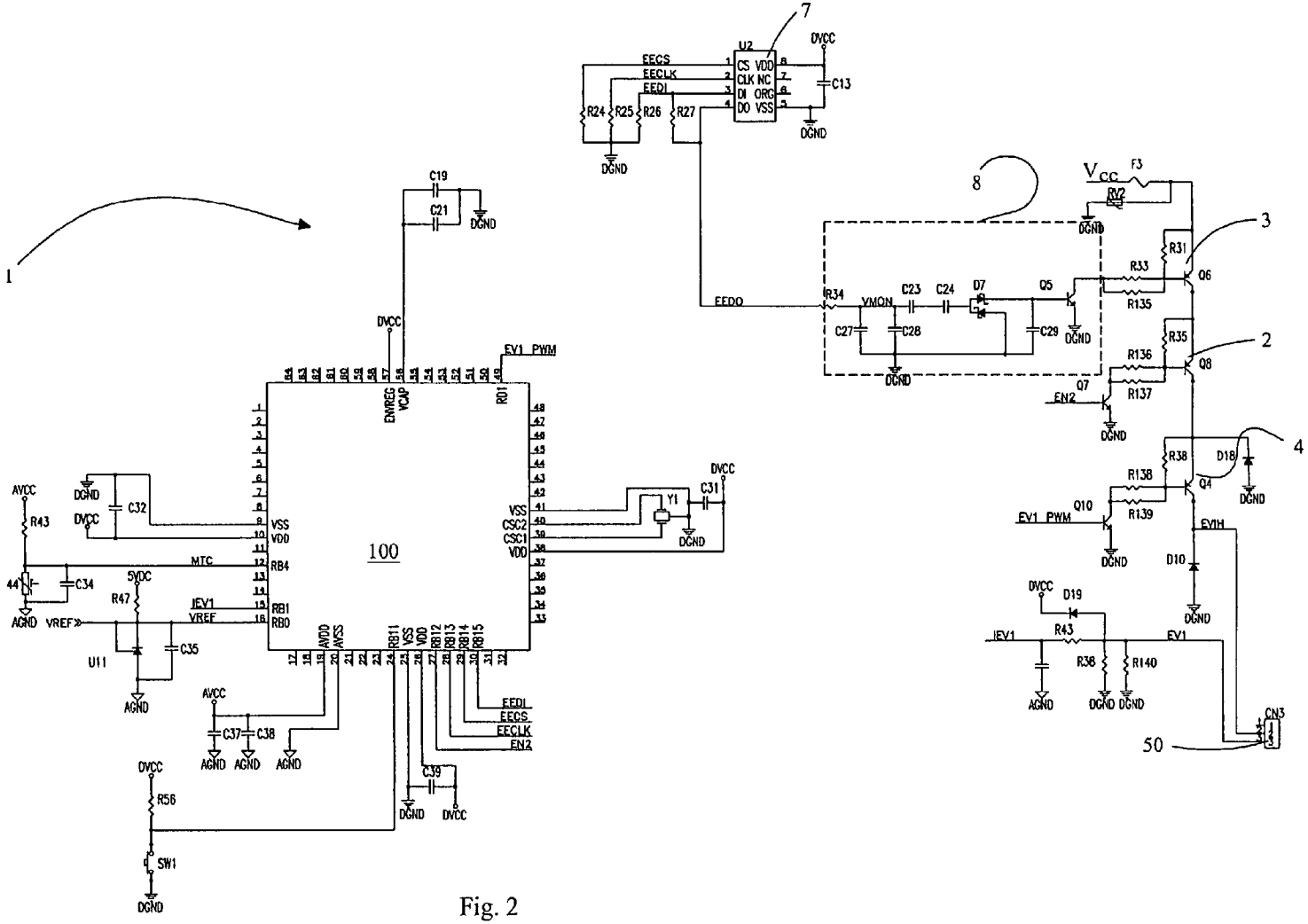
FIG. 2 is a circuit diagram of a second embodiment of the circuit in FIG. 1.

The valve (also not shown, in FIG. 3 it is connected to the branch indicated by IEV1L) may for example be an on/off valve which can be opened and closed through an electromagnet and whose opening and closing may therefore be controlled by a suitable actuator such as a relay 50. However any valve whose opening/closing is activated by a suitable actuator is included in the teaching of this invention. The valve which permits the delivery of the gas in the present preferred embodiment is open when relay 50 is energised, and otherwise closed.

Control circuit 1 can control actuator control 50 and as a consequence control opening/closing of the valve.

In greater detail, actuator 50 (which in a different preferred embodiment may also be more than one in number) can be energised, that is receive an electrical current, through switching on at least two switches, referred to respectively as first and second switches 2, 3, for example a first and a second transistor. When one of the two switches is off (and obviously also when both the switches are off) the actuator is not energised and the valve to which it is connected is closed. The switches may be two or more in number, and also other types of static switches, not only transistors, may be used. Furthermore, according to the invention it is possible for only the second switch to be present, the first being present for further safety.

The two switches 2, 3 are connected together in such a way that both must be switched on by two separate signals, referred to below as "on-signals" in order to energise relay 50. In the configuration in FIG. 1 the two transistors 2, 3 are connected in series and the collector of the first transistor is connected to a branch of relay 50, whose opposite branch is set at a potential difference $V_{dc}$, while the emitter of first transistor 2 is connected to the collector of second transistor 3, the emitter of which is connected to earth, so that only when a first and a second signal come together as an input to the first and second bases of the two transistors respectively can current flow in circuit 1 and energise relay 50.

Control circuit 1 comprises a control unit 100, for example a microcontroller, connected to a first switch 2 and capable of generating a first voltage signal $V_1$ from its outlet 100$V_1$ which is sent as an input to the base of first switch 2. Signal $V_1$ is a static signal of the on/off type, that is a step signal which is alternately equal to zero when no signal is present or a voltage signal which is substantially constant over time. Delivery of such signal $V_1$ therefore sets first switch 2 to on, that is first signal $V_1$ is a signal to "switch on" switch 2, which in the absence of such signal remains off.

Control unit 100 is also capable of generating a second voltage signal $V_2$ from an output 100$V_2$, for example a square wave, and a clock signal CK, from an outlet 100CK, which is also a square wave, which together switch on second switch 3 in a manner described below. Signals CK and $V_2$ are dynamic signals, for example they are signals having a frequency of 30 and 5 KHz respectively and a maximum amplitude of 5 V and 0 V respectively.

Between control unit 100 and second switch 3 there is a memory 5, which includes an input 5I, an output 5U separate from input 5I, and a further input 5CK for the clock signal. Memory 5 is connected to control unit 100 in such a way that signal $V_2$ is delivered to input 5U and the clock signal CK is sent to input CK of memory 5. Clock signal CK and voltage signal $V_2$ can reach the memory unchanged (that is as emitted by control unit 100), or may be processed, filtered, etc.

Memory 5 is able to emit an on-signal $V_3$, the second signal switching on circuit 1 through output 5U, signal $V_3$ which is a function of input signal $V_2$, and the clock signal CK. On-signal $V_3$ is then sent as an input to switch 3 to switch it on.

If the valve has to remain closed, signal $V_2$ sent by control unit 100 may for example be of the type "0 0 0 0 0 0 0 0 0" (that is no voltage signal is emitted from the output of the microprocessor), or alternatively, in the case where the valve has to be opened by energising relay 50 on-signal $V_2$ may be of the type "1 0 1 0 1 0 1 0" (square wave).

In reality signal $V_2$ does not directly switch on switch 5, that is its presence is not sufficient to switch on switch 3, because it does not directly generate on-signal $V_3$ whose generation requires the further presence of the clock signal CK as detailed below, the actual on-signal is signal $V_3$. This signal is preferably substantially similar to input signal $V_2$ which comes from control unit 100, more preferably it is identical to the signal from the microprocessor. Signal $V_2$ and clock signal CK are two independent signals generated independently of each other by the microprocessor.

Preferably, memory 5 comprises a register 7, more preferably an internal sliding register, in which data from the communication line between microprocessor 100 and memory 5 come together, that is signal $V_2$ reaches register 7. Each bit of signal $V_2$ replaces one bit present in register 7 and at the same time on the other side of the register a corresponding bit is emitted as an output signal $V_3$ of memory 5.

Input clock signal CK therefore has a safety function, while signal $V_3$ (a signal which as described in this preferred example is identical to $V_2$ "shifted" along the length of register 7, although signal $V_2$ may be processed in other ways by memory 5, and furthermore signal $V_3$ may also be different from signal $V_2$) reaches second switch 3 and switches it on only if clock signal CK is present, and more particularly only if the correct combination between clock signal CK and input signal $V_2$ reaches memory 5 as an input.

For each clock pulse the devices unit 100 and memory 5 which are in communication emit a bit from their internal register replacing it by another bit, in the case of memory 5 a bit of register 7 is replaced by a bit of the $V_2$ signal originating from microprocessor 100. In the case therefore where a clock signal is not emitted and/or this does not reach the memory, this replacement of the bit in register 7 does not take place and on-signal $V_3$ is not emitted correctly, thus preventing switch 3 from being switched on, for example it will be not switched on if a signal of the 0 0 0 0 0 type is emitted.

Control unit 100 is therefore only able to switch on the gas delivery valve under particular conditions, that is when both on-signals $V_2$ and CK are sent to memory 5, and more preferably for greater safety when $V_1$ and $V_3$ are sent to the two switches 2 and 3 at the same time. If only one of these signals $V_2$ and CK is absent, switch 3 will not switch on and therefore relay 50 cannot be energised, while for further safety, preferably if only one of these signals $V_3$ and $V_1$ is missing, one of the two switches 2, 3 will not switch on and relay 50 will also not be capable of being energised in this situation.

Memory 5 is preferably a slave SPI; that is communication between control unit 100 and memory 5 is provided according to the SPI communication standard in which unit 100 is the master and memory 5 is the slave. Thus the clock signal sent by unit 100 to memory 5 is the serial clock signal providing the timing for the emission and reading of bits on data lines. The data line, that is the line on which the data reach memory 5, is the connection between the microprocessor and the memory along which signal $V_2$ is transmitted.

Memory 5 may for example be an EEPROM memory.

According to a variant of the invention signal $V_3$ does not reach the base of transistor 3 directly, but through a module 8 in which it is transformed into a static signal $V_3'$, similar to signal $V_1$. Module 8 includes for example a plurality of condensers.

Sliding register 7 is responsible for output signal $V_3$ from the memory: substantially input signal $V_2$ is re-emitted signal $V_3$ from memory 5 after a certain number of clock cycles if a clock signal is correctly emitted at the right frequency.

Memory 5 is connected to second switch 3, that is in particular to the base of transistor 3, so when signal $V_3$ reaches the base of transistor 3, in the case where transistor 2 is also on (i.e. signal $V_1$ reaches its base), then current can flow from the first transistor to earth and therefore relay 50 is energised and the gas delivery valve consequently opens.

If there is any fault, for example if signal $V_1$ is not emitted or is not correctly emitted the relay is not energised because both switches 2 and 3 must be on so that current can pass.

In addition to this, according to a preferred example, control circuit 1 also comprises a further switch, transistor 4, again controlled by control unit 100, as a result of which a further signal $V_4$ has to be emitted (also for example a static step signal similar to $V_1$) so that the relay can only be energised if switch 4 is also on through a properly-emitted voltage signal $V_4$. Thus if several faults occur, or in the case in which $V_1$ is emitted correctly in error, there is the further safety of the need for $V_4$ to also be present.

Similarly it is not sufficient for an erroneous $V_2$ signal to be sent to memory 5, and it is not sufficient for an on-signal to be sent to the memory instead of an off-signal provided that the correct clock signal should be sent at the same time, or the proper combination between clock signal and $V_2$ must be emitted from microprocessor 100 for the memory to emit output on-signal $V_3$ and therefore switch on second transistor 3.

The invention claimed is:

1. A control and safety circuit (1) for gas delivery valves, comprising:

an actuator (50) for opening the gas delivery valve;

a control unit (100) designed to emit a command signal ($V_2$), and a clock signal (CK), the control unit (100) being capable of generating a further command signal (V1) to activate the actuator (50);

a memory (5) placed between the control unit (100) and the actuator (50), the memory being capable of receiving the command signal ($V_2$) and the clock signal (CK) as inputs, the memory emitting an output signal ($V_3$) which is a function of the input command signal ($V_2$) and the clock signal (CK), the output signal ($V_3$) being sent to the actuator (50) to command the same to open the valve; and a first switch (3) connected to the actuator (50), the first switch—when in an on operating position—controlling the actuator (50) to open the valve and the first switch (3) being capable of moving into the on operating position on receipt of the output signal ($V_3$) from the memory (5), a second switch (2) connected to the actuator (50), the further command signal ($V_1$) being sent as an input to the second switch (2) which is capable of moving into the on operating position on receipt of the further command signal ($V_1$), the further command signal ($V_1$) is a step signal which is alternately equal to zero when no signal is present or a voltage signal which is substantially constant over time, wherein the first switch (3) and the second switch (2) are connected in series for controlling the actuator (50) to open the valve so that the actuator (50) is energized to open the valve only when both the switch (3) and the second switch (2) are in the on operating position.

2. The control and safety circuit (1) according to claim 1, wherein the memory (5) includes a sliding register (7).

3. The control and safety circuit (1) according to claim 1, wherein the memory (5) emits the output signal ($V_3$) when the clock signal (CK) and the input signal ($V_2$) from the control unit (100) are received as inputs and satisfy specific preset parameters.

4. The control and safety circuit (1) according to claim 2, wherein the memory (5) is an SPI device.

5. The control and safety circuit (1) according to claim 1, wherein the control unit (100) is a microcontroller.

6. The control and safety circuit (1) according to claim 1, in which the first switch (3) is a transistor and the output signal ($V_3$) from the memory (5) is delivered as an input to its base.

7. The control and safety circuit (1) according to claim 1, wherein the second switch (2) is a transistor and the additional command signal ($V_1$) from the control unit (100) is delivered to its base as an input.

8. The control and safety circuit according to claim 1, wherein the actuator (50) is a relay.

* * * * *